US006481054B1

(12) United States Patent
Hillstrom

(10) Patent No.: US 6,481,054 B1
(45) Date of Patent: Nov. 19, 2002

(54) HINGE ASSEMBLY FOR SIGN HAVING FLIP DISPLAY

(75) Inventor: Brian J Hillstrom, Milford, MI (US)

(73) Assignee: Marketing Displays, Inc., Farmington Hills, MI (US)

( * ) Notice: Subject to any disclaimer, the term of this patent is extended or adjusted under 35 U.S.C. 154(b) by 0 days.

(21) Appl. No.: 09/793,324

(22) Filed: Feb. 26, 2001

(51) Int. Cl.[7] ..... E05D 5/02; E05D 7/12

(52) U.S. Cl. ..... 16/252; 16/253; 16/254; 16/271; 16/86.1; 40/5; 40/492

(58) Field of Search ..... 16/252, 253, 254, 16/271, 87.2, 86.1; 24/17 B, 284, 30.5 P, 324; 40/5, 492, 588; 248/74.1, 68.1

(56) References Cited

U.S. PATENT DOCUMENTS 81,805 A * 9/1868 McCall et al. ..... 16/253
1,685,080 A * 9/1928 Auchincloss ..... 40/588
2,065,624 A * 12/1936 Summers ..... 211/50
3,496,666 A * 2/1970 Morley ..... 40/530
3,571,861 A * 3/1971 Olson ..... 24/30.5 P
4,010,503 A * 3/1977 Denton ..... 16/87.2
4,178,710 A * 12/1979 Schmid ..... 40/530
4,373,235 A * 2/1983 Korgaonkar ..... 24/282
5,018,768 A * 5/1991 Palatchy ..... 24/284
5,395,079 A * 3/1995 Jensen et al. ..... 248/62

* cited by examiner

*Primary Examiner*—Chuck Y. Mah
(74) *Attorney, Agent, or Firm*—Harness, Dickey & Pierce, P.L.C.

(57) ABSTRACT

A hinge assembly for operably coupling a flip panel display to a sign panel is disclosed. The hinge assembly includes pair of hinge clips having an interlocking feature formed thereon. The pair of hinge clips are assembled in an opposed facing relationship such that the interlocking features engage one another to secure the hinge assembly to the sign panel.

38 Claims, 4 Drawing Sheets

HINGE ASSEMBLY FOR SIGN HAVING FLIP DISPLAY

BACKGROUND OF THE INVENTION

1. Technical Field

The present invention relates generally to a mounting device for signs, and more particularly to an improved hinge clip assembly for hingedly coupling a plurality of flip display panels to a sign panel.

2. Discussion

Commercial signs are designed to display advertising and images for products or services. However, some information or images related to the products or services may vary over the duration of time in which the sign is viewed by consumers. In certain applications, the fluctuation of the information requires frequent changes directly on the sign. For example, the price of a product or the time of a service, such as a viewing of a movie, may fluctuate. Many signs provide a manner in which information on the sign can be displayed but cannot easily be modified.

Signs commonly used to display frequently changing information may include flip displays that allow changes in the information or images. Flip displays have a plurality of panels bearing alphanumeric information or images. The panels are located next to each other so that one panel can be flipped to change the information or image displayed. For example, if two panels are next to each other, a first panel located in an upper panel position bears the upper half of a number upon it and the second panel located in a lower panel position bears the lower half of a number upon it such that the two panels form a complete number. Additional panels bearing additional information or images are located beneath the first and second panels, stacked and hidden out of view. This set of flip panels is arranged to allow flipping of each panel from one position to another. Thus, the second panel can be flipped into an upper panel position over the first panel, thereby exposing a third panel in the lower panel position and the second side of the second panel in the upper panel position. With the panels retained in this configuration, information or images on the third panel and newly exposed second side of the second panel are viewed.

Conventionally, a circular hinge clip is located adjacent the flip panels and secure the flip panels to the sign panel such that each panel can be flipped between a lower panel position and an upper panel position. Such hinge clips are secured to the sign with a rivet or similar fastener. While such hinge clips have provided an adequate means for coupling the flip display to the sign panel, the head of a riveted fastener may disrupt the information displayed on the sign. In view of this and other drawbacks of conventional hinge clips, there is a need for an improved hinge assembly which is inexpensive to manufacture, simple to install and easy to operate.

SUMMARY OF THE INVENTION

It is therefore an object of this invention to provide an improved hinge assembly having a pair of hinge clips which interconnect from opposite sides of a sign panel. It is another object of the present invention to provide an improved hinge clip assembly which is inexpensive to manufacture, simple to install and easy to operate. These and other objects are provided by a hinge assembly and sign display apparatus. The hinge assembly of the present invention includes pair of hinge clips having a U-shaped mid-section and an interlocking feature formed at the ends thereof. The pair of hinge clips are assembled in an opposed facing relationship such that the interlocking features engage one another to secure the hinge assembly to the sign panel.

BRIEF DESCRIPTION OF THE DRAWINGS

The various advantages of the present invention will become apparent to one skilled in the art by reading the following specification and subjoined claims and by referencing the drawings in which:

FIG. 6 is a perspective view showing a second preferred embodiment of a hinge assembly in accordance with the present invention;

FIG. 7 is an exploded perspective view of the hinge shown in FIG. 6;

FIG. 8 is a cross-sectional view of the hinge assembly taken along line B—B showing in FIG. 6;

DETAILED DESCRIPTION OF THE PREFERRED EMBODIMENT

Figure 1:
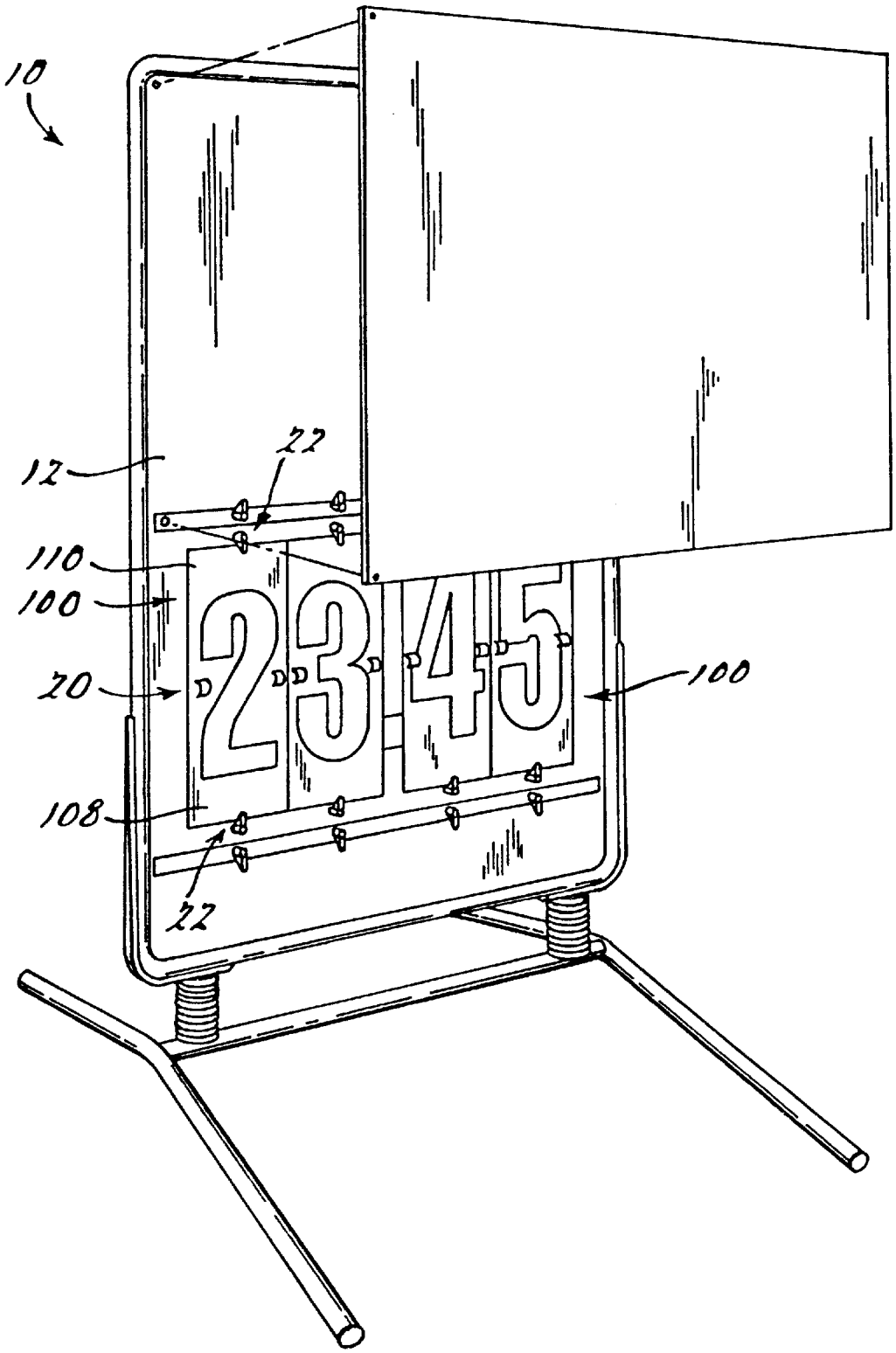
FIG. 1 is a perspective view showing a preferred embodiment of the present invention in a sign display.

With reference to the drawings and in particular FIG. 1, a display sign 10 is illustrated having a sign panel 12 and a plurality of flip displays 100. Each flip display 100 includes a set of flip panels 102–110 which when combined form a desired alphanumeric representation. Panels 102–110 are arranged in a stacked manner to form a conventional flip display 100 that can modified by rotating the individual flip panels.

A pair of hinge assemblies 20 interconnects flip panels 102–110 and 102'–110' (located on the opposite side of panel 12) and releasably secures the flip display 100, 100' to the sign panel 12. The panels 102–108 are shown in a lower panel position and the panel 110 is shown in an upper panel position. A latch pin assembly 22 is disposed adjacent a side of flip display 100 opposite hinge assembly 20 and functions to selectively retain the panels 102–110 of flip display 100 in a desired configuration. As can be seen in FIG. 1, a latch assembly is strategically located adjacent various flip panels and is positionable between a locked position and an unlocked position to retain the flip panel is in a desired configuration.

Figure 2:
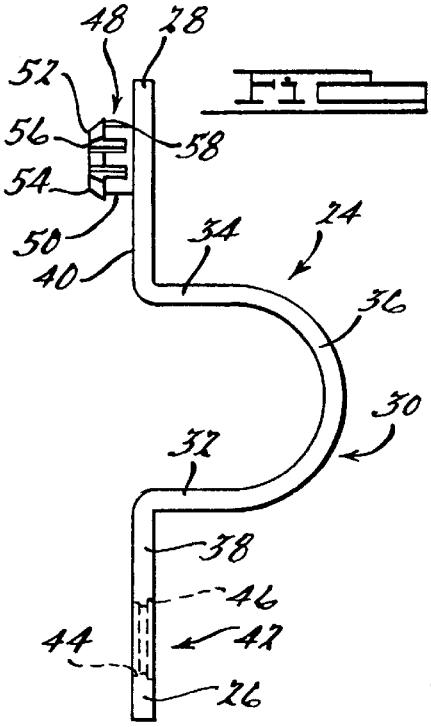
FIG. 2 is a perspective view showing a first preferred embodiment of a hinge assembly in accordance with the present invention.
Figure 3:
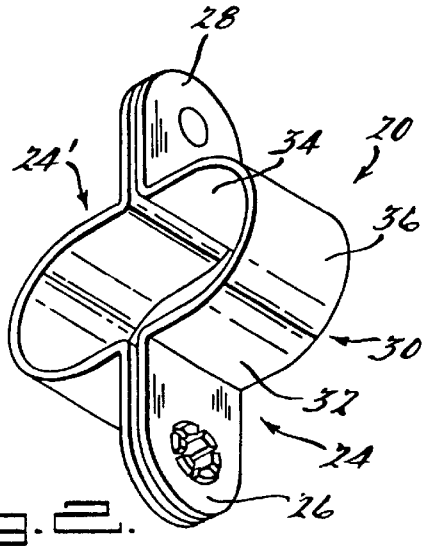
FIG. 3 is a side view showing a hinge clip of the hinge assembly of FIG. 2.
Figure 4:
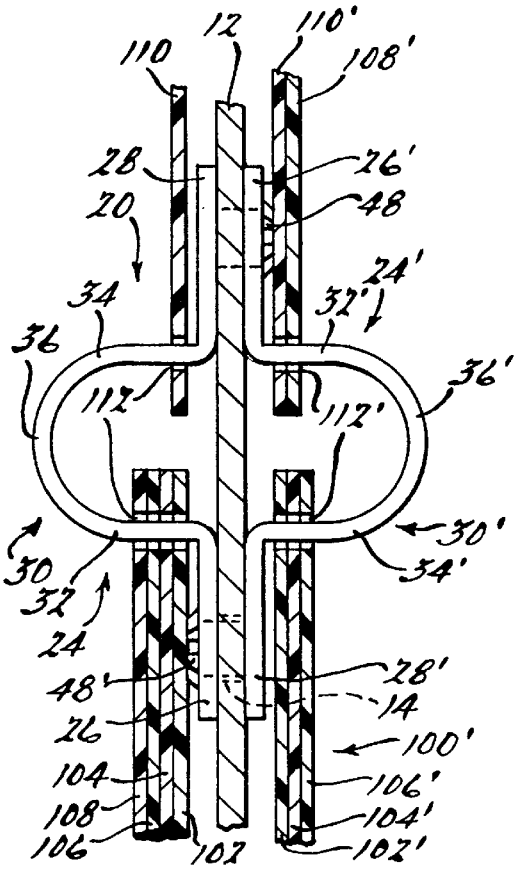
FIG. 4 is a cross-sectional view of the hinge assembly taken along line A—A showing in FIG. 1.

With reference now to FIGS. 2–4, a first preferred embodiment of hinge assembly 20 is illustrated in detail. Hinge assembly 20 includes a pair of hinge clips 24, 24' releasably secured to one another with sign panel 12 interdisposed therebetween. Hinge clips 24, 24' is preferably made of a weather-resistant material such as plastic and includes a pair of tabs or feet 26, 26' and 28, 28' interconnected by a generally U-shaped mid-section 30, 30' having a pair of leg portions 32, 32' and 34, 34' extending from an arcuate central portion 36, 36'. Feet 26, 28 and 26', 28' are substantially coplanar and are interconnected perpendicular to leg portions 32, 32' and 34, 34' of mid-section 30, 30' extending outwardly therefrom. Foot 26, 26' has an aperture 42, 42' formed therethrough. Foot 28, 28' has a connector pin 48, 48' extending therefrom.

As presently preferred, hinge clip 24' is identical in design to hinge clip 24. Accordingly, further reference will be made in the singular to hinge clip 24. The hinge clip 24 is preferably a monolithic body having an outer surface 38 facing away from the sign panel 12 and an inner surface 40 facing toward the sign panel 12. A tapered countersink feature 44 is formed on the inner surface 40 of the foot 26 adjacent the aperture 42. Another countersink feature 46 is formed on the outer surface 38 of foot 26 adjacent aperture 42. Connector pin 48 extends from the inner surface 40 and includes a shank 50 having an outer diameter slightly smaller than aperture 42 and retaining flange 52, having an outer diameter larger than aperture 42. Retaining flange 52 has a tapered leading edge 54 formed thereon. A plurality of longitudinal slots 56 are formed in pin 48 to permit radial flexing for allowing retaining flange 52 to pass through aperture 42. Tapered leading edge 54 in combination with countersink 44 further facilitates insertion of pin 48 through aperture 42. Countersink 46 positively locates retaining flange 52 with foot 26 once pin 48 is completely inserted through aperture 42.

While the first preferred embodiment of hinge assembly 20 includes a pair of identically designed hinge clips each having an aperture and a pin, one skilled in the art will readily recognize that one hinge clip of the present invention could be provided with a pair of pins extending therefrom, while the other hinge clip could be provided with a pair of apertures adapted to receive the pins. Alternately, in applications where a hinge assembly is needed on only one side, one hinge clip could be a flat retaining clip having an aperture formed therein and a pin extending therefrom. Such modifications would result in a structure which is equivalent to that disclosed as the first preferred embodiment and are to be considered within the scope of the present invention.

Figure 5:
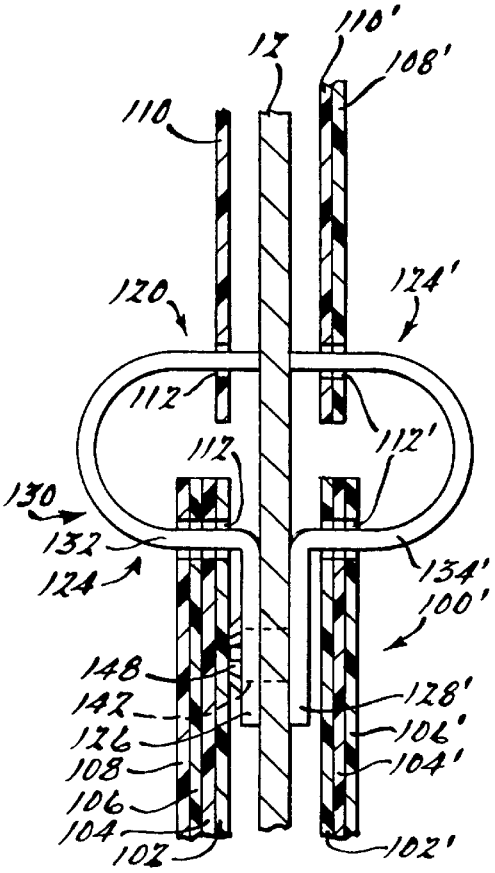
FIG. 5 is a cross-sectional view of an alternate embodiment of the first preferred embodiment of the hinge assembly of the present invention.
Figure 1:
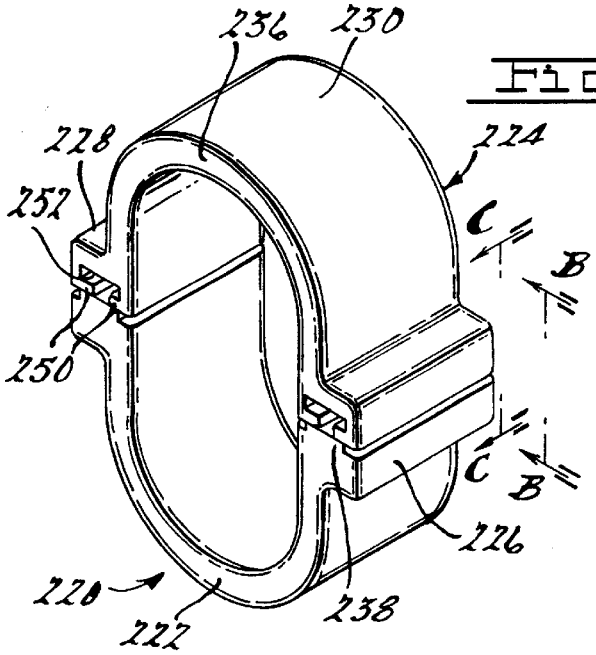
Figure 2:
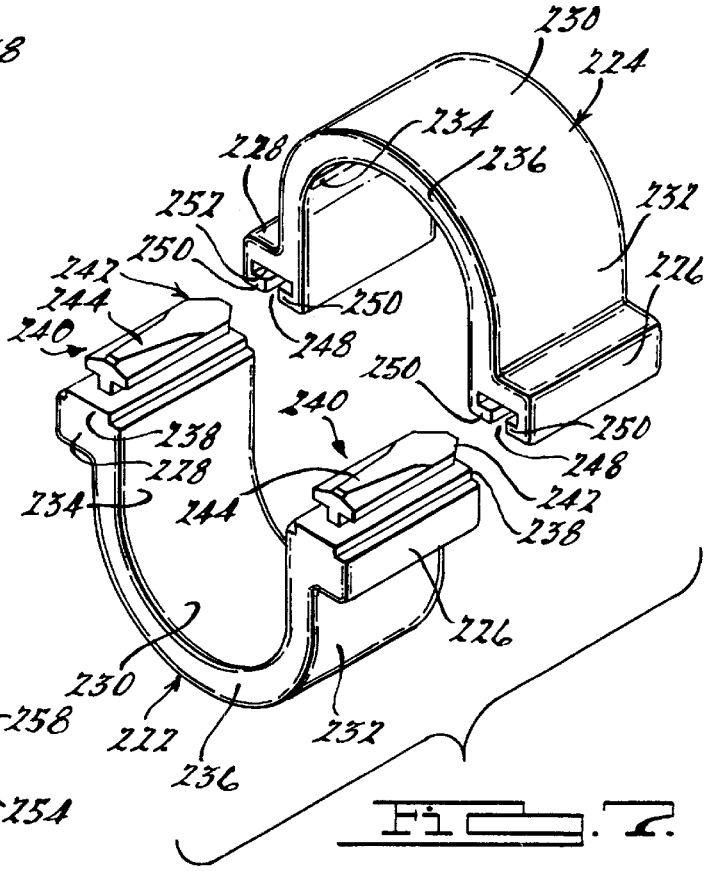
Figure 3:
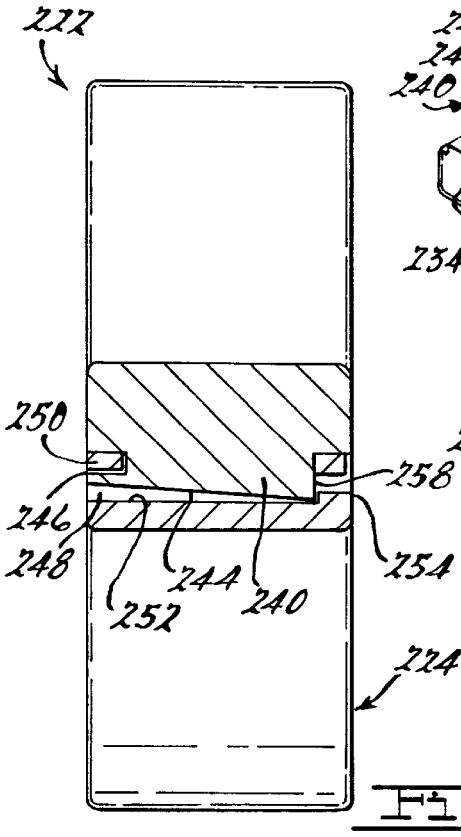
Figure 9:
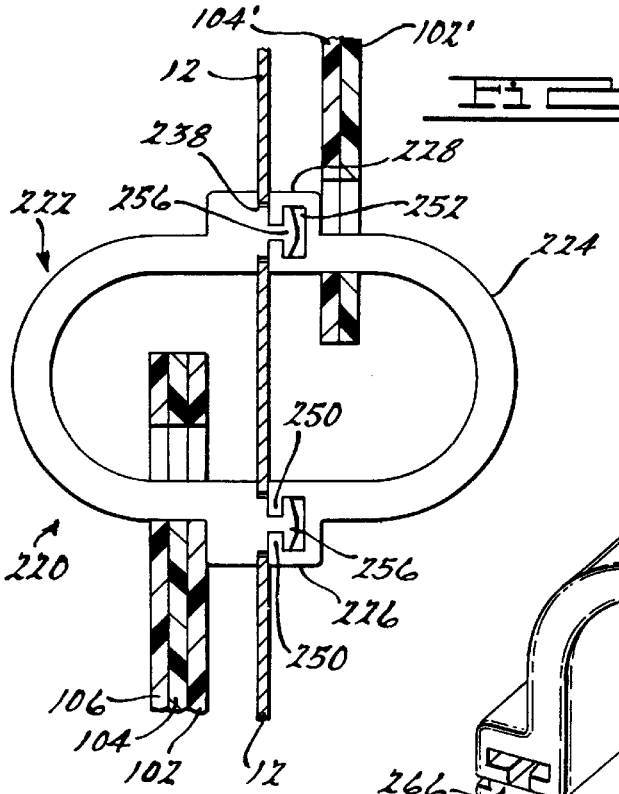
FIG. 9 is a cross-sectional view of the hinge assembly taken along line C—C showing in FIG. 6.

With reference now to FIG. 5, an alternate preferred embodiment of the hinge assembly is illustrated. Hinge assembly 120 includes a pair of hinge clips 124, 124' releasably coupled to one another with sign panel 12 interdisposed therebetween. Hinge clip 124 includes a foot 126 extending outwardly from a leg portion 132 of U-shaped mid-section 130. Hinge clip 124' includes a foot 128' extending outwardly from a leg portion 134' of U-shaped mid-section 130'. Foot 126 has an aperture 142 extending therethrough. Foot 128 has a connector pin 148 extending therefrom. In this regard, hinge assembly 120 is similar to hinge assembly 20 but releasably secured to the sign panel 12 by feet 126, 128 instead of two pairs of feet. Alternately, in applications where a hinge assembly is needed on only one side hinge clip 124' could be a flat retainer having an aperture formed therein or a pin extending therefrom. Such a modification would result in a structure which is equivalent to that disclosed as the alternate preferred embodiment and is to be considered within the scope of the present invention.

With reference now to FIGS. 2 and 4, the assembly of hinge assembly 20 will now be described. A plurality of flip panels 102–110 are loaded onto hinge clips 24, 24' by passing foot 26 through slots 112, 112' formed in the flip panels 102–110 and 102'–110'. The flip panels 102–110 are then located on mid-sections 30. Hinge clip 24' is oriented in an opposed facing relationship to hinge clip 24 such that pins 48 are aligned with apertures 42. Pins 48 are inserted through apertures 14 formed in leading sign panel 12 and then received in apertures 42. Countersink 44, tapered leading edge 54 and slots 56 facilitates insertion of pins 48 into apertures 42 by allowing the retaining flange 52 of pin 48 to contract radially inwardly. When pin 48 is fully inserted in aperture 42, the flange 52 of pin 48 expands radially outwardly and shoulder 58 of retaining flange 52 resides in countersink 46 of foot 26 to releasably secure hinge clips 24, 24' to sign panel 12. In this manner, pins 48 and apertures 42 function as an interlocking mechanism for releasably coupling the hinge assembly 20 to the sign panel 12. Leg portions 32, 34 provide an resting area where the flip panels 102–110 can be positioned in a parallel arrangement relative to sign panel 12 as best seen in FIG. 5. The flip panels 102–110 may now be freely positioned between the lower panel position and the upper panel position. With reference to FIG. 5, the assembly of hinge assembly 120 is similar to that of hinge assembly 20 with the alignment of only one pin and one aperture being required.

With reference to FIGS. 6–9, a second preferred embodiment of the hinge assembly 220 is illustrated. Hinge assembly 220 includes male hinge clip 222 and female hinge clip 224 releasably secured to each other with sign panel 12 (not shown) interdisposed therebetween. As best seen in FIG. 7, hinge clips 222, 224 each include base portions or feet 226, 228 connected by a generally U-shaped mid-section 230 having leg portions 232, 234 extending from accurate centered portion 236. Feet 226, 228 of male hinge clip 222 includes a shoulder 238 which operatively locates in the complementary aperture (not shown) of sign panel. Extending from shoulder 238 is key 240 for locating and securing male hinge clip 222 with female hinge clip 224. Key 240 has a T-shaped cross-section which extends transversely along shoulder 238. Additionally, key 240 has a pointed end 242 and a tapered ramp 244 located at the leading tip 246 of T-shaped cross-section which facilitates alignment and assembly of hinge assembly 220. Feet 226, 228 of female hinge clip 224 have T-shaped slots 248 which are complimentary to and receive keys 240 of male hinge clip 222. T-shaped slot 248 defines a pair of laterally extending flanges 250 and an inner surface 252. As best seen in FIG. 8, a step 254 is formed in the end of slot 248 and functions as a snap lock feature for securing hinge clips 222, 224 together. More specifically, key 240 is inserted into slot 248 and female hinge 224 is moved transversely relative to male hinge 222. Such relative movement causes ramp 244 to push against step 254 and inner surface 252 of slot 248, thereby urging flanges 250 defined by slot 248 against the span portion 256 of T-shaped key 240. Further relative positioning increases the fictional force between hinge clips 222, 224. Once step 254 passes trailing tip 258 of key 240, step 254 functions as a stop for preventing disengagement of keys 240 with slots 248.

Figure 10:
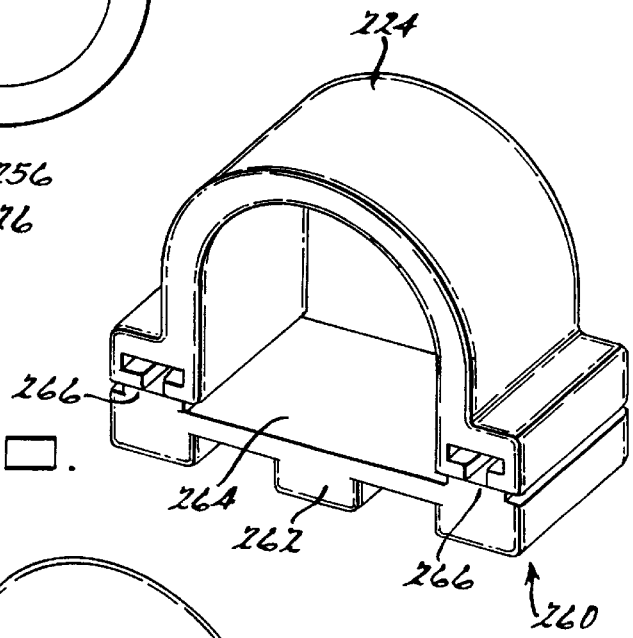
FIG. 10 is a perspective view showing an alternate embodiment of the hinge assembly shown in FIG. 6.
Figure 11:
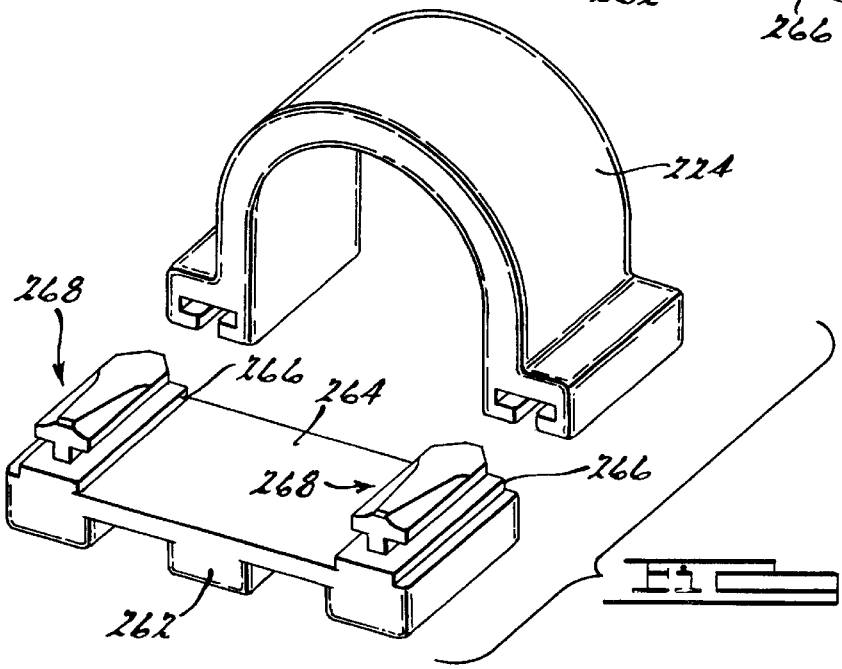
FIG. 11 is an exploded perspective view of the hinge shown in FIG. 10.

An alternate design of the second preferred embodiment of the hinge clip is shown in FIGS. 10 and 11 which provides a hinge assembly on a single side of sign panel 12. Hinge assembly 260 includes female hinge clip 224 which is identical to that describe above and flat clip 262. Flat clip 262 is a generally rectangular body having a flat inner surface 264. Shoulders 266 and key 268 are formed transversely on clip 262 and extend away from inner surface 264. These features are identical to those previously described with respect to male hinge clip 222. Flat clip 262 attaches to female hinge clip 224 in the manner described with respect to hinge assembly 220. Hinge assembly 260 is used in applications where a flip display is located on only one side of the sign panel 12, for example, when mounting a flip display to a panel that is mounted on a wall. While the second preferred embodiment includes a male hinge clip and a female hinge clip, one skilled in the art will readily recognize that the hinge clips of the present invention could be provided with a key at a slot formed in each hinge clip. Such modification would result in a structure which is equivalent to that disclosed as the second preferred embodiment and would be considered within the scope of the present invention.

From the foregoing description, one skilled in the art will readily recognize that the present invention provides a hinge assembly which improves the design, simplifies the manufacture and reduces the cost of assembling various signs incorporating flip panel displays. While the present invention has been described with reference to a preferred embodiment, certain changes, modifications and variations may be made without departing from the spirit and scope of the present invention as define by the following claims.

What is claimed is:

1. A hinge assembly for operably coupling a flip display panel to a sign comprising:

a first hinge clip having a first hinge portion adapted to support a flip display panel, a first base portion extending outwardly from said first hinge portion and a post disposed on said first base portion; and a second hinge clip having a second base portion with an aperture formed therein; and a compliant retaining element interposed between said post and said aperture;

wherein said first hinge clip is positioned in an opposed facing relationship with and moved relative to said second hinge clip such that said compliant retaining element flexes when said aperture receives said post to releasably secure said first and second hinge clips together in an assembled state.

2. The hinge assembly of claim 1 wherein said first base portion comprises a first foot extending outwardly from said first hinge portion and a second foot extending outwardly from said first hinge portion in a direction opposite said first foot.

3. The hinge assembly of claim 1 wherein said compliant retaining element comprises a retaining flange formed on an end of said post and said aperture comprises a throughbore in said second base portion, wherein said first hinge clip is aligned with and pushed towards said second hinge clip such that said retaining flange is received in said throughbore to releasably secure said first and second hinge clips together in said assembled state.

4. The hinge assembly of claim 3 wherein said retaining flange is radially compliant.

5. The hinge assembly of claim 4 wherein said retaining flange has a longitudinal slot formed therein.

6. The hinge assembly of claim 3 wherein said retaining flange has a tapered leading face formed thereon.

7. The hinge assembly of claim 3 wherein said aperture has a countersink formed on an inner surface of said second base portion.

8. The hinge assembly of claim 1 wherein said post comprises a key extending from said first base portion and said aperture comprises a slot formed in said second base portion for receiving said key, said first hinge clip being moved transversely in a first direction with respect to said second hinge clip such that said key slides into said slot to releasably secure said first and second hinge clips together in said assembled state.

9. The hinge assembly of claim 8 wherein said key has a T-shaped cross-section and said slot has a cross-section that is complementary to said T-shaped cross-section.

10. The hinge assembly of claim 8 wherein said key has a pointed leading end formed thereon.

11. The hinge assembly of claim 8 wherein an upper surface of said key has a ramp formed thereon such that a height of said key above said first base portion increases in said first direction.

12. The hinge assembly of claim 8 further comprising a stop formed at one end of said slot which engages said key when said first and second hinge clips are in said assembled state.

13. The hinge assembly of claim 1 wherein said second hinge clip comprises a second hinge portion adapted to support another flip display panel, said second base portion extending outwardly from said second hinge portion.

14. A hinge assembly for operably coupling a flip display panel to a sign comprising:

a first hinge clip adapted to support a flip display panel, said first hinge clip having a first central portion, a first pair of legs extending from said first central portion and terminating at a first pair of feet, a first pin extending from one of said first pair of feet and having a first shank and a first retaining flange formed on an end of said first shank, and another of said first pair of feet having a first aperture formed therethrough; and a second hinge clip adapted to support another flip display panel, said second hinge clip having a second central portion, a second pair of legs extending from said second central portion and terminating at a second pair of feet, a second pin extending from one of said second pair of feet and having a second shank and a second retaining flange formed on an end of said second shank, and another of said second pair of feet having a second aperture formed therethrough;

wherein said first hinge clip and said second hinge clip are adapted to be positioned on opposite sides of a sign in an opposed facing relationship such that said first pin is inserted into said second aperture and said second pin is inserted into said first aperture for releasably securing said first and second hinge clips together in an assembled state.

15. A hinge assembly for operably coupling a flip display panel to a sign panel comprising:

a first hinge clip adapted to support a flip display panel, said first hinge clip having a first central portion, a first pair of legs extending from said first central portion and terminating at a first pair of feet, each of said first pair of feet having a T-shaped key extending therefrom; and a second hinge clip adapted to support another flip display panel, said second hinge clip having a second central portion, a second pair of legs extending from said second central portion and terminating at a second pair of feet, each of said second pair of feet having a slot formed therein for receiving said T-shaped key;

wherein said first hinge clip and said second hinge clip are adapted to be positioned on opposite sides of a sign in an opposed facing relationship, said first hinge clip being slid transversely in a first direction with respect to said second hinge clip such that said key slides into said slot for releasably securing said first and second hinge clips together in an assembled state.

16. A sign display comprising:

a sign panel having a sign aperture formed therethrough;

a first movable display panel having a slot formed therein;

a second moveable display panel having a slot formed therein; and a first hinge clip having a first hinge portion extending through said slots formed in said first and second moveable display panels, a first base portion extending outwardly from said first hinge portion, and a first interlocking mechanism formed on said first base portion; and a second hinge clip having a second base portion formed thereon and a second interlocking mechanism formed on said second base portion;

wherein said first hinge clip and said second hinge clip are positioned on opposite sides of said sign panel in an opposed facing relationship such that at least one of said first and second interlocking mechanisms extends through said sign aperture, said first hinge clip being moveable relative to said second hinge clip such that said first interlocking mechanism engages said second interlocking mechanism to releasably secure said first and second hinge clips together.

17. The sign display of claim 16 wherein said first and second interlocking features comprise a pin extending from said first base portion and having a shank and a retaining flange formed on an end of said shank and said second base portion having an aperture formed therethrough, wherein said first hinge clip is aligned with and pushed towards said second hinge clip such that said pin is received in said aperture to releasably secure said first and second hinge clips together in said assembled state.

18. The sign display of claim 17 wherein said pin has a longitudinal slot formed therein.

19. The sign display of claim 17 wherein said retaining flange has a tapered leading face formed thereon.

20. The sign display of claim 17 wherein said aperture has a countersink formed on an inner surface of said second base portion.

21. The hinge assembly of claim 17 wherein said retaining flange is radially compliant.

22. The sign display of claim 16 wherein said first and second interlocking mechanisms comprise a key extending from said first base portion and said second base portion having a slot formed therethrough for receiving said key, said first hinge clip being moved transversely in a first direction with respect to said second hinge clip such that said key slides into said slot to releasably secure said first and second hinge clips together in said assembled state.

23. The sign display of claim 22 wherein said key has a T-shaped cross-section and said slot has a cross-section that is complementary to said T-shaped cross-section.

24. The sign display of claim 22 wherein said key has a pointed leading end formed thereon.

25. The sign display of claim 22 wherein an upper surface of said key has a ramp formed thereon such that a height of said key above said first base portion increases in said first direction.

26. The sign display of claim 22 further comprising a stop formed at one end of said slot which engages said key when said first and second hinge clips are in said assembled state.

27. The sign display of claim 16 wherein said second hinge clip comprises a second hinge portion adapted to support another flip display panel, said second base portion extending outwardly from said second hinge portion.

28. The sign display of claim 16 wherein said first base portion comprises a first foot extending outwardly from said first hinge portion and a second foot extending outwardly from said first hinge portion in a direction opposite said first foot.

29. A hinge assembly for operably coupling a flip panel display to a sign panel comprising:

a first hinge clip having a first hinge portion adapted to support a flip display panel, a first base portion extending outwardly from said first hinge portion, and a pin extending from said first base portion, said pin having a shank and a retaining flange formed on an end of said shank;

a second hinge clip having an aperture formed therein;

wherein said first hinge clip and said second hinge clip are adapted to be positioned on opposite sides of a sign panel in an opposed facing relationship, said first hinge clip being moveable relative to said second hinge clip such that said pin is received in said aperture to releasably secure said first and second hinge clips together.

30. The hinge assembly of claim 29 wherein said retaining flange is radially compliant.

31. The hinge assembly of claim 29 wherein said pin has a longitudinal slot formed therein.

32. The hinge assembly of claim 29 wherein said retaining flange has a tapered leading face formed thereon.

33. The hinge assembly of claim 29 wherein said second hinge clip has a countersink is formed therein adjacent said aperture.

34. A hinge assembly for operably coupling a flip panel display to a sign panel comprising:

a first hinge clip having a first hinge portion adapted to support a flip display panel, a first base portion extending outwardly from said first hinge portion, and a key extending from said first base portion; and a second hinge clip having a second base portion formed thereon and a slot formed in said second base portion for receiving said key;

wherein said first hinge clip and said second hinge clip are adapted to be positioned on opposite sides of a sign panel in an opposed facing relationship, said first hinge clip being moved transversely in a first direction with respect to said second hinge clip such that said key slides into said slot to releasably secure said first and second hinge clips together.

35. The hinge assembly of claim 34 wherein said key has a T-shaped cross-section and said slot has a cross-section that is complementary to said T-shaped cross-section.

36. The hinge assembly of claim 34 wherein said key has a pointed leading end formed thereon.

37. The hinge assembly of claim 34 wherein an upper surface in said key has a ramp formed thereon such that the height of said key above said first base portion increases in said first direction.

38. The hinge assembly of claim 34 wherein said slot includes a stop feature at one end of said slot which engages said key when said first and second hinge clips are in an assembled condition.

* * * * *

UNITED STATES PATENT AND TRADEMARK OFFICE

CERTIFICATE OF CORRECTION

PATENT NO. : 6,481,054 B1
DATED : November 19, 2002
INVENTOR(S) : Brian J. Hillstrom It is certified that error appears in the above-identified patent and that said Letters Patent is hereby corrected as shown below:

Title page,
Item [57], ABSTRACT,
Line 2, after "includes" insert -- a --;

Column 1,
Line 66, after "includes" insert -- a --;

Column 2,
Line 48, after "can" insert -- be --;
Line 61, after "panel" delete "is";

Column 4,
Line 17, "an" should be -- a --;
Lines 43-44, "complimentary" should be -- complementary --;
Line 55, "fictional" should be -- frictional --;
Line 63, "describe" should be -- described --;

Column 5,
Line 23, "define" should be -- defined --;

Column 8,
Line 32, after "countersink" delete "is".

Signed and Sealed this

Eleventh Day of March, 2003

JAMES E. ROGAN
*Director of the United States Patent and Trademark Office*